US010371372B2

(12) United States Patent
Von Zell

(10) Patent No.: US 10,371,372 B2
(45) Date of Patent: Aug. 6, 2019

(54) CANDLEHOLDER AND METHOD

(71) Applicant: Suzetta D. Von Zell, Joshua Tree, CA (US)

(72) Inventor: Suzetta D. Von Zell, Joshua Tree, CA (US)

( * ) Notice: Subject to any disclaimer, the term of this patent is extended or adjusted under 35 U.S.C. 154(b) by 156 days.

(21) Appl. No.: 15/112,823

(22) PCT Filed: Jan. 21, 2015

(86) PCT No.: PCT/US2015/012294
§ 371 (c)(1),
(2) Date: Jul. 20, 2016

(87) PCT Pub. No.: WO2015/112631
PCT Pub. Date: Jul. 30, 2015

(65) Prior Publication Data

US 2016/0334096 A1 Nov. 17, 2016

Related U.S. Application Data

(60) Provisional application No. 61/964,973, filed on Jan. 22, 2014.

(51) Int. Cl.
*F21V 35/00* (2006.01)
*F21V 21/14* (2006.01)

(52) U.S. Cl.
CPC ..... *F21V 35/00* (2013.01); *F21V 21/14* (2013.01)

(58) Field of Classification Search
None
See application file for complete search history.

(56) References Cited

U.S. PATENT DOCUMENTS

| | | | | |
|---|---|---|---|---|
| 89,811 | A * | 5/1869 | Robertson et al. | F21V 35/00 431/290 |
| 1,734,572 | A | 11/1929 | Gordon | |
| 2,750,775 | A * | 6/1956 | Robertson | F21V 35/00 431/289 |
| 3,556,704 | A | 1/1971 | Grasznick | |
| 2006/0060592 | A1* | 3/2006 | Kamite | B29C 47/003 220/737 |
| 2010/0086887 | A1* | 4/2010 | Klewe | C11C 5/00 431/291 |

FOREIGN PATENT DOCUMENTS

| | | |
|---|---|---|
| DE | 9107253 | 1/1991 |
| GB | 2457545 | 8/2009 |

* cited by examiner

*Primary Examiner* — Sharon E Payne
(74) *Attorney, Agent, or Firm* — Law Offices of David M. Lang; David M. Lang

(57) ABSTRACT

Aspects of the present invention disclose a candleholder that may be manipulated by a user to advance a candle within a candleholder to facilitate optimal burning. Embodiments describe a candleholder having a platform to move a candle within a holder. Embodiments disclose a prepackaged semi-soft candle, which is readily movable against a candleholder's inner surface. Embodiments of the present invention disclose a handle permitting a user to manipulate platform height, allowing a candle to be raised or lowered within a candleholder. Embodiments disclose a disc, sized larger than the platform, preferably formed of a soft rubber sponge which stabilizes the candle and prevents candle wax from moving below the platform's surface. An alternative embodiment omits the disc, the platform being sealed by a seal around the platform's perimeter.

4 Claims, 16 Drawing Sheets

CANDLEHOLDER AND METHOD

CROSS-REFERENCE TO RELATED APPLICATIONS

The present application is a national stage application of International Patent Application PCT/US2015/012294 filed, Jan. 21, 2015. International Patent Application PCT/US2015/012294 claims the benefit under 35 U.S.C. § 119(e), to U.S. Provisional Application 61/964,973, filed Jan. 22, 2014, entitled "CANDLEHOLDER II AND METHOD" which is incorporated by reference in its entirety and made part of this specification.

FIELD OF THE INVENTION

The present invention relates generally to the field of candleholders, and more particularly to user manipulated candleholders permitting a user to adjust a candle's position within a candleholder.

BACKGROUND

Candleholders have been known in the art for some time, and traditional wax candles utilize wax candles in a glass candle holder which are sold full. Over time the candle's wax and wick are consumed, resulting in the candle surface becoming progressively lower relative to the candleholder's surface opening. As a result, certain challenges are presented. Candles burning low in a candleholder are more difficult to light, may allow less air and oxygen to the flame. Further, as a candle burns, the wick may be frayed and discolored, and a user desires to trim the candle's wick. Where the wick position is low in a candleholder, this task is more difficult. Further, many candles are scented, and burning a scented candle releases scent into the surroundings. To optimize scent dissipation, it is useful to have a candle burn near a candleholder's surface—not deep within a candleholder. Further, wax candles tend to be relatively hard and immobile within a candleholder. Lastly, candles burning deep within candleholders typically leave unsightly black soot or carbon deposits on the candleholder's interior making the candleholder, and often candle, black, unsightly, and sooty appearing.

SUMMARY

Aspects of the present invention disclose a candleholder that may be manipulated by a user to advance a candle within a candleholder to facilitate optimal burning. Embodiments describe a candleholder having a platform to move candle within the holder. Embodiments disclose a prepackaged semi-soft candle, bundled with a candleholder, wherein the semi-soft candle is readily movable against a candleholder's inner surface. Embodiments of the present invention disclose a handle permitting a user to manipulate platform height, allowing a candle to be raised or lowered within a candleholder. Embodiments disclose a disc, sized larger than the platform, preferably formed of soft rubber sponge which stabilizes the candle and prevents candle wax from moving below the platform's surface. Embodiments disclose omission of the disc, and utilization of a platform shaped to define at least one seal at the perimeter.

DRAWINGS

DESCRIPTION

Figure 1:
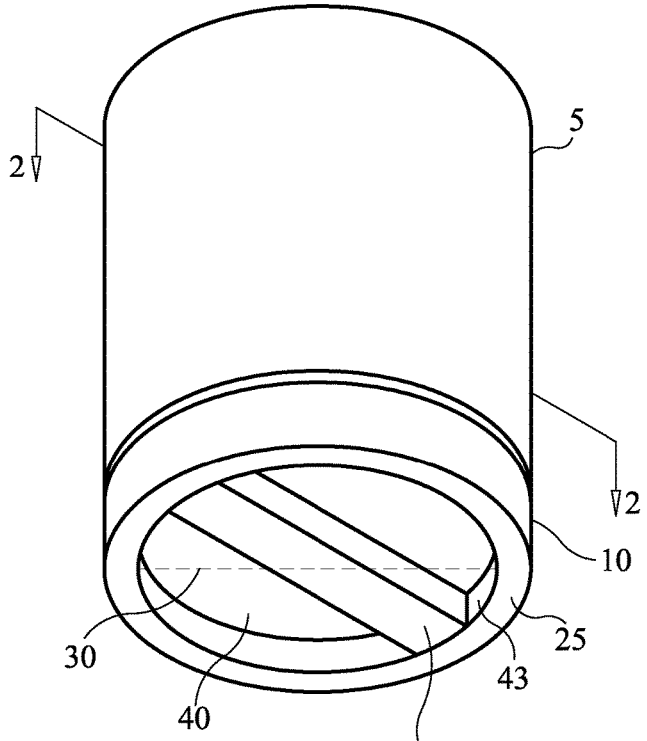
FIG. 1 is a perspective view of an embodiment candleholder.
Figure 2:
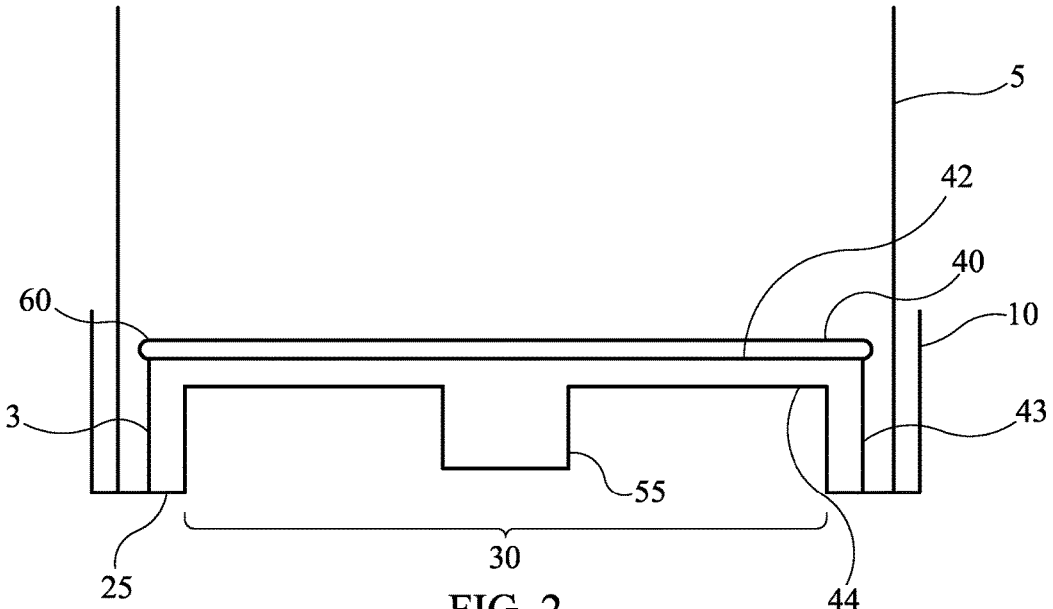
FIG. 2 is a cross-section of an embodiment candleholder taken through line 2-2 of FIG. 1.
Figure 3:
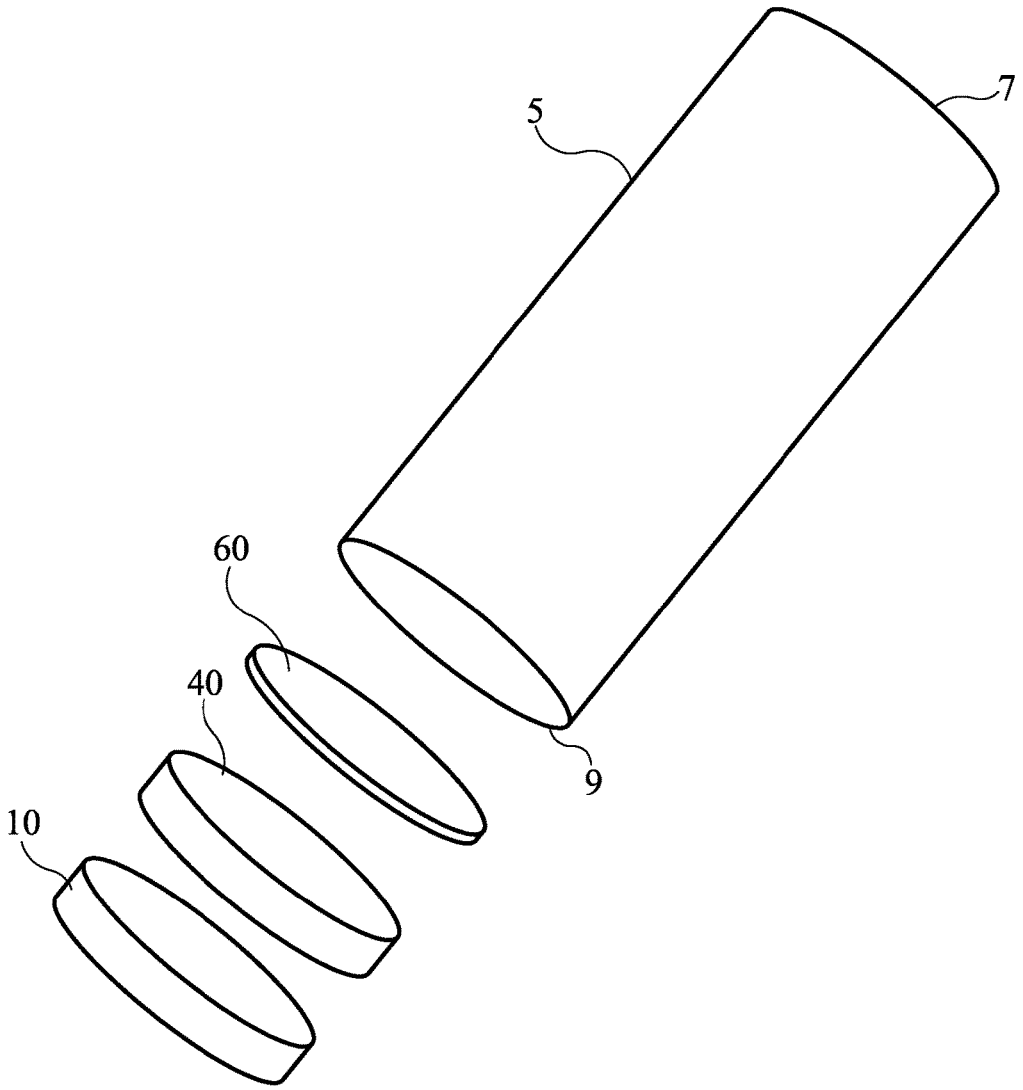
FIG. 3 is an exploded view of an embodiment candleholder.

Turning now to FIGS. 1-3, a candleholder has cylindrical candle barrier 5 has a first end 7 and second end 9 and a diameter and diametrical void. Barrier 5 has a short axis and long axis. Base 10 is affixed to the second end 9 of barrier 5. In one embodiment, base 10 is adhesively affixed. In an alternative, base 10 is coupled by snap or press fit. The base 10 is shaped to define a base bottom surface 25 and base bottom surface opening 30 across the diameter from one base bottom surface 25 to the opposing edge. A piston or platform 40 spans substantially across barrier 5's short axis to substantially fill barrier 5's diametrical void. Platform 40 is shaped to define a platform top 42, platform bottom 44, a platform sidewall 43, and a platform handle 55 (best seen by FIG. 2). Platform 40 has a circumferential surface 3. Platform 40 sidewall 43 aids in stabilizing platform 40 within cylindrical barrier 5. Platform 40 is sized to have a greater diameter than base bottom surface opening 30.

FIG. 2 is a cross-section taken through line 2-2 of FIG. 1. Disc 60 is disposed on the top surface 42 of platform 40, in one embodiment being adhesively affixed. Disc 60 has a diameter larger than the diameter of platform 40, and thus overhangs platform 40. In a preferred embodiment, disc 60 is comprised of foam rubber sponge. In use, when platform 40 is moved upwardly within barrier 5, the perimeter of disc 60 seals barrier 5 and retains wax above disc 60's surface. Base bottom opening 30 serves as a platform access opening where a user may access platform 40 and platform 40's handle 55. FIG. 3 illustrates an exploded view, demonstrating base 10, platform 40, disc 60 and cylindrical barrier 5. The difference in size between platform 40 and base bottom opening 30 maintains platform 40 between base 10 and inside barrier 5 and prevents platform 40 from being dislodged from the candleholder.

During use, a user applies force to platform 40, when the desired candle position is reached, the user withdraws the application of force. Frictional contact between platform 40 and/or disc 60 and the inner surface of barrier 5 provides sufficient force to maintain platform 40 and a candle in a static position.

In one embodiment, an inventive method is disclosed including, providing a candle; providing a cylindrically shaped candle barrier 5 having a first end 7 and second end 9, and inner surface, wherein said cylindrical candle barrier has a diameter and diametrical void, wherein said cylindrical candle barrier has a short axis and long axis. A base 10 affixed to the second end 9 of cylindrical candle barrier 5, the base having a base bottom surface 25, wherein said base is shaped to define a base bottom opening 30 having a diameter. A platform 40 has a diameter, wherein said platform's 40 diameter is less than the diameter of said cylindrical candle barrier 5, wherein the platform 40 is sized to substantially fill the diametrical void of the barrier 5 across the short axis of said cylindrical candle barrier 5, wherein said platform 40 is shaped to define a handle 55, wherein said platform 50 is shaped to define a top surface 42 and a sidewall 43, wherein the diameter of the platform 40 is greater than the diameter of the base bottom surface opening 30; a disc 60 disposed on the top surface 42 of platform 40, wherein said disc 60 has a diameter, wherein the diameter of the disc is larger than the diameter of the platform 40. Placing said candle within said barrier 5 on the disc 60. Determining a desired candle height and applying force along the barrier's 5 long axis, wherein the user directs force in the direction of the first end 7 sufficient to move platform 40, disc 60, and candle toward first end 7. The user recognizes that the desired candle height has been reached and withdraws the application of force, wherein the forward movement of the platform 40, disc 60, and candle ceases. The frictional contact between the platform 40 and disc 60, within the barrier's 5 inner surface maintains the platform 40, disc 60, and candle in a static position.

Figure 4:
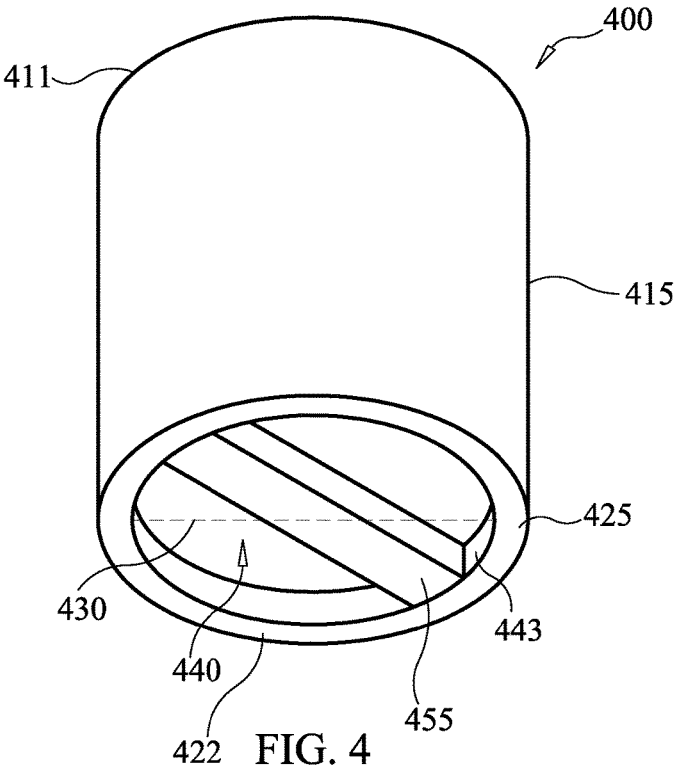
FIG. 4 is a perspective view of an embodiment integrally formed candleholder.

FIG. 4 demonstrates an alternative preferred embodiment, cylindrical candle barrier 5 and base 10 are omitted as independent elements. An integrally molded candleholder 400 is described. FIG. 4 illustrates a perspective view of an integrally molded candleholder body 415 shaped to define a cylindrically shaped molded candleholder body 415 having a first end 411 and a second end 422, where the second end 422 is a molded bottom 425 further shaped to define a molded bottom opening 430. Platform 440 is disposed within candleholder body 415. Platform 440 has a diameter larger than the diameter of opening 430, thus platform 440 is prevented from passing through opening 430 and out of candleholder body 415.

Figure 5:
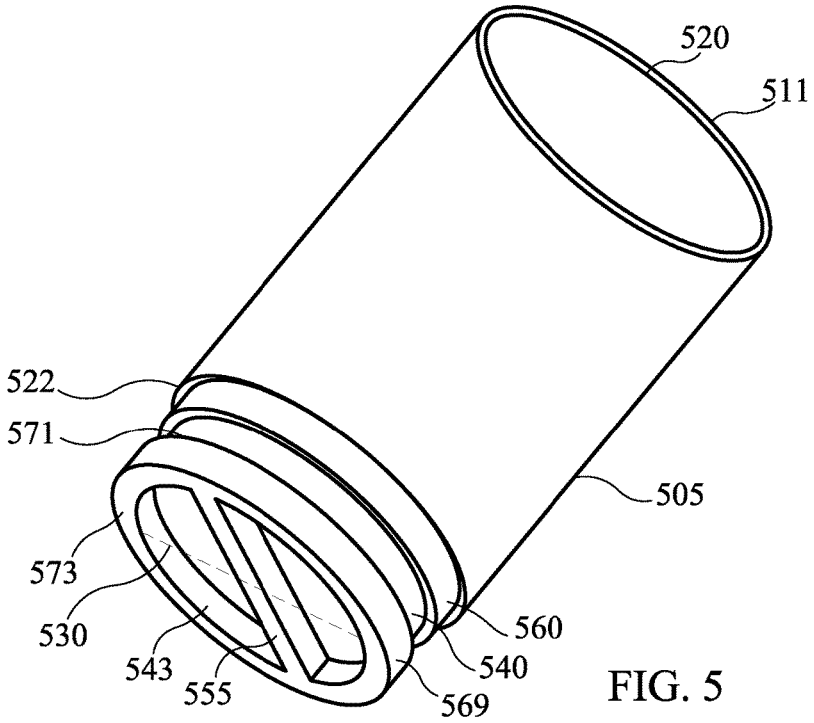
FIG. 5 is a perspective view of an embodiment candleholder where the base is disposed substantially within the barrier.
Figure 6:
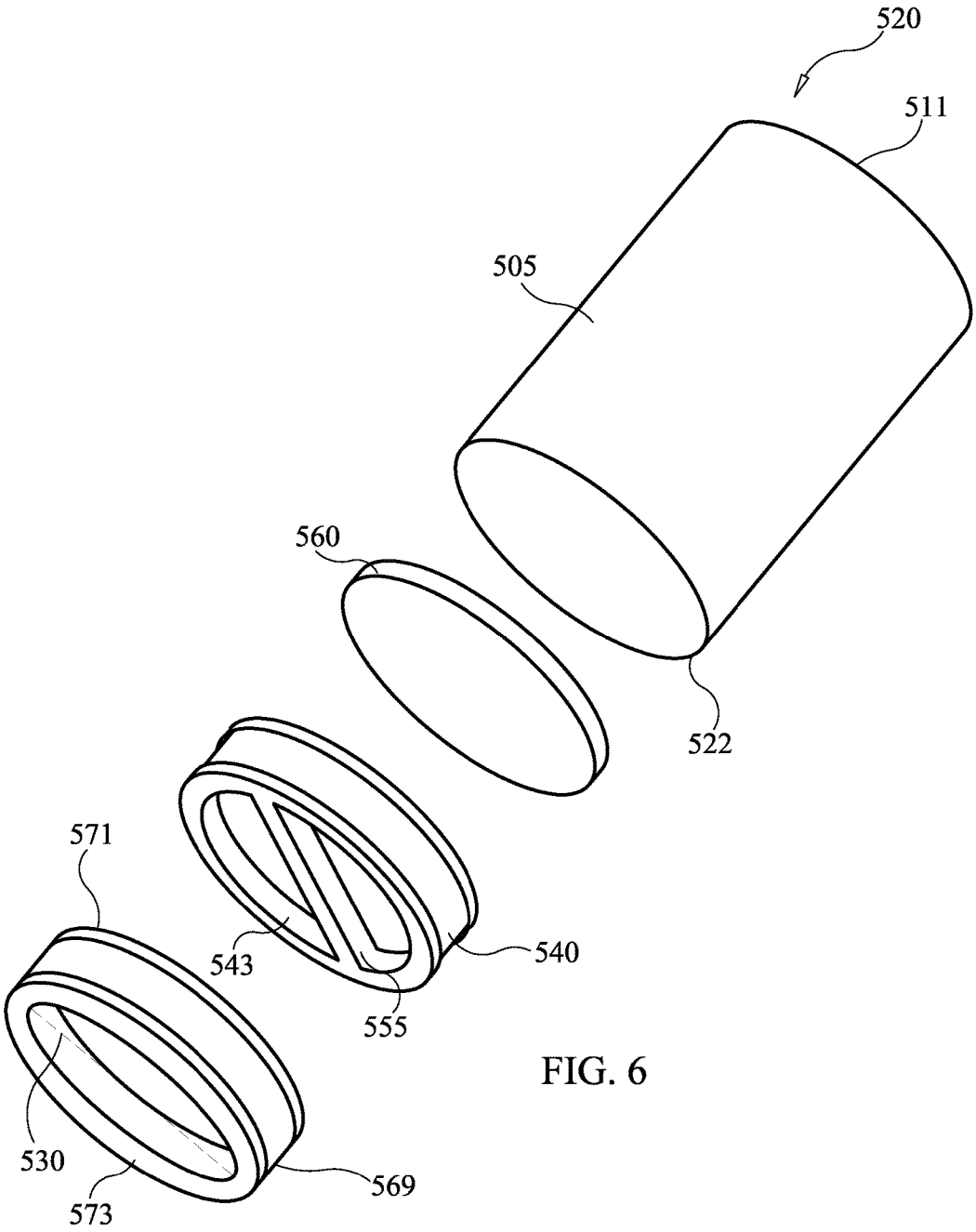
FIG. 6 is an exploded view of an embodiment candleholder where the base is disposed substantially within the barrier.

FIGS. 5 and 6 demonstrate an internal platform stopper embodiment. In this embodiment, a cylindrically shaped candle barrier 505 having a first end 511 and second end 522, wherein said cylindrical candle barrier 505 has a diameter and diametrical void, wherein said cylindrical candle barrier 505 has a short axis and long axis. A base 569 shaped to define a top end 571 and bottom end 573, said base 569 affixed substantially within the second end of cylindrical candle barrier 505, the base 569 having a bottom end, wherein said base 569 is shaped to define a base bottom opening 530 having a diameter, wherein said bottom end 573 of said base 569 defines a candleholder footing. A platform 540 is sized to substantially fill the diametrical void of cylindrical candle barrier 505 across the short axis of said cylindrical candle barrier 505, wherein said platform 540 is shaped to define a handle 555, wherein said platform 540 shaped to define a top surface and a sidewall, wherein the diameter of the platform 540 is greater than the diameter of the base bottom surface opening 530, wherein the top 571 of base 569 defines a platform stop. A disc 560 disposed on the top surface of platform 540, wherein said disc 560 has a diameter, wherein the diameter of the disc is larger than the diameter of the platform 540.

In use, a user may move a candle disposed on said disc 560 in the direction of the long axis of said cylindrical candle barrier, in the direction of the first end, wherein a candle, as it is consumed, may be advanced such that a candle surface may be maintained near the relative first end.

Figure 7:
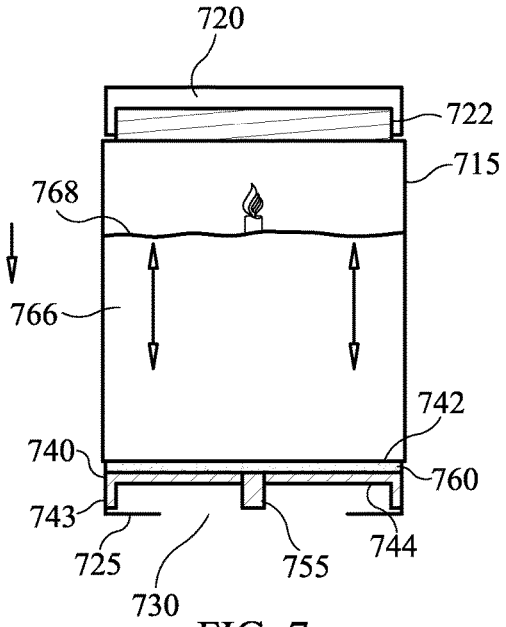
FIG. 7 is a schematic view showing an embodiment candleholder.

Turning now to FIG. 7, a candleholder features candleholder body 715 which may be formed of metal (including tin), alloy, acrylic, urethane, wood, and in a preferred embodiment—glass, or any material capable of withstanding heat generated from wick burning, relatively centrally, within. Candleholder body may be cuboidially shaped and in a preferred embodiment is cylindrically shaped. Candleholder body 715 has a top end 720 and bottom end 725. Bottom end 725 is shaped to define at least one platform access opening 730. Platform 740 is disposed within candleholder body 715. Platform 740 is shaped to define a top surface 742 and bottom surface 744 and perimetrical surface, which in one preferred embodiment is a circumferential surface 743, best appreciated by FIG. 16. In embodiments disclosed herein generally, platform shape approximates the shape of candleholder body across the short axis, with the platform occupying at least 70% of the candleholder body's cross-sectional area.

The circumferential surface 743 is in close contact with the inner surface of candleholder body 715. In one embodiment, illustrated by FIGS. 23 and 24, the perimetrical surface may be sealed by seal 2367 and seal 2476 respectively, making contact with a candleholder's inner surface.

Figure 22:
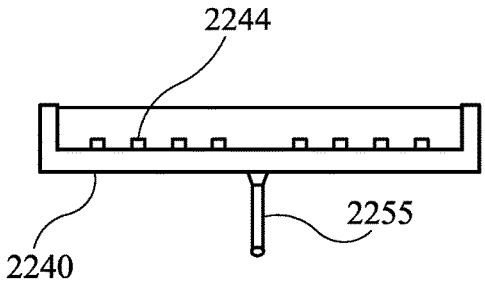
FIG. 22 is a side view of an embodiment platform.

In one embodiment, a portion of platform 40's bottom surface 44 is shaped to define a platform handle 755. The platform access opening 730 and platform handle 755 are positioned such that a user can access platform handle through platform access opening 730. In one embodiment, the platform handle may be a foldable handle 2255 (FIG. 22). In various embodiments, platform handle 755 is integrally molded.

Candleholder body 715 has a body bottom 725. Body bottom 725 is shaped to define at least one platform access opening 730 through which platform 740 is accessible.

In one embodiment, platform access opening 730 is shaped wide enough to allow an average human index finger. In another embodiment, platform access opening 730 is shaped wide enough to allow access to at least a portion of platform push handle 755. In one embodiment platform access opening 730 is sized in the range of 1 cm to 12 cm.

Disc 760 is disposed on top surface 742 of platform 740 within candleholder body 715. In a preferred embodiment, disc 760 operates as a candle securing member and is comprised of a rubber sponge. Disc 760 may be affixed adhesively.

Candleholder body 715 has top end 720. In one embodiment, top end 720 has a top end engagement 722 to permit a cover to be secured on candleholder body 15. In one embodiment, top end engagement is a threaded engagement 1005 (FIG. 10) to accommodate a threaded cover which may be twisted on and secured. Engagement 722 may be flush to accommodate a friction fit cover. Engagement 722 may have a ridge to allow a ridged cover to be snapped on.

In one embodiment of the present invention, a candle 766 may be prepackaged with the holder. Candle 766 is set within candleholder body 15 and on top of a candle securing member, such as disc 60. In a preferred embodiment, candle 766 is a soft candle such as soy or soy blend, palm wax, soft paraffin.

In an alternative embodiment, candleholder body 715 is packaged without the candle. In this embodiment, wax, in a flowable state, may be poured into candleholder body 715 and allowed to cool. This may occur in a factory/manufacturer setting or may be poured by a user. In one embodiment, a candleholder body is sold as a kit to an end user, with wax varieties independently obtainable, allowing a user to heat and melt wax suitable for pouring into the candleholder. Platform 740 is sealed sufficiently against the inner wall of candleholder body 715 by disc 760 to keep wax, liquid, semisolid, or solid, substantially above platform 740.

It is generally useful to have the surface of a candle 766 burning as close as possible to the opening on top end 720. As candle 766 burns wax and wick are consumed and decrease; the candle's top surface 768 becomes lower relative to candleholder top end 720. A candle burning near the top end 720 will allow more oxygen to the flame, will burn better, provide more light, enhance the dissipation of candle scent, and create less smoke. In addition, a candle closer to a candleholder top surface will be easier to light, and the wick easier to trim.

A user may advance candle 766's top surface 68 in the direction of top end 720 by accessing platform 740 through platform access opening 730. In one embodiment, a user introduces a finger or digit through platform access opening 730 and makes contact with platform 40 and exerts pressure sufficient to move platform 740 and candle 766 upward toward top end 720. In another embodiment, user extends the foldable handle 1555 (FIG. 15), which forms a portion of platform 740, grasps handle 1555 and exerts a pushing force in the direction of top end 720 sufficient to move platform 740 and candle 766 upward toward top end 720. The user, desiring to move candle 766, downwardly grasps handle 1555 and exerts a pulling force in the direction of bottom end 725 sufficient to move platform 740 and candle 766 downwardly toward bottom end 725.

Figure 8:
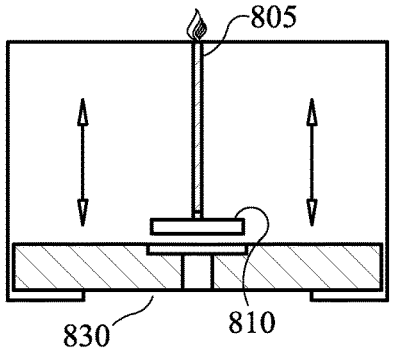
FIG. 8 is a schematic view showing an embodiment wick fitting.

FIG. 8 discloses a candle with a push in wick 205 on metal base 210. In one embodiment, wick 805 may be factory assembled and adhesively affixed. In an alternative embodiment, a candleholder may be sold as a kit, replacement wicks being available. In this embodiment, more than one wick may be utilized and reversibly snapped into place.

Figure 9:
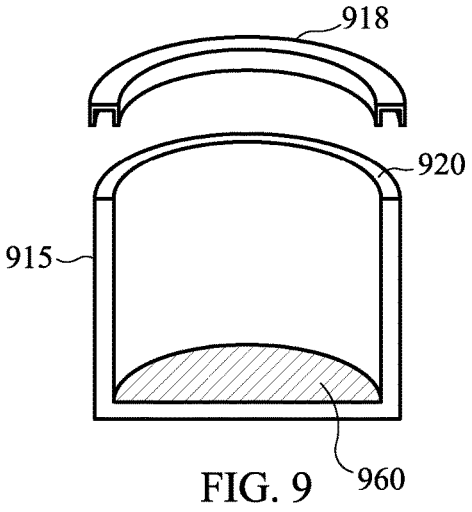
FIG. 9 is a schematic view showing an embodiment ring stop.

FIG. 9 illustrates a schematic sectional view of an embodiment candleholder body 915 featuring a stop ring 918. In one embodiment, stop ring 918 is affixed to the outer circumference of candleholder top end 920. Stop ring 918 can be made of metal, or other materials, and press-fitted or glued to the circumferential surface of candleholder top end 920. In one embodiment, candleholder body is shaped to define stop ring such that stop ring is integrally formed. FIG. 9 also illustrates disc 960. It should be noted that a stop ring can be integrally formed by manufacturing a glass prominence, heat resistant plastic or urethane prominence, or by rolled tin.

Figure 10:
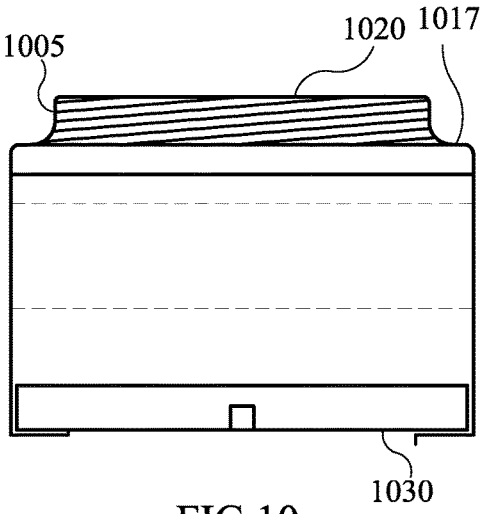
FIG. 10 is a schematic view showing an embodiment threaded first end.

FIG. 10 discloses an embodiment candleholder body 1015 shaped to define a necked-in candle stop 1017. FIG. 10 additionally illustrates top end 1020 having threading 1005.

Figure 11:
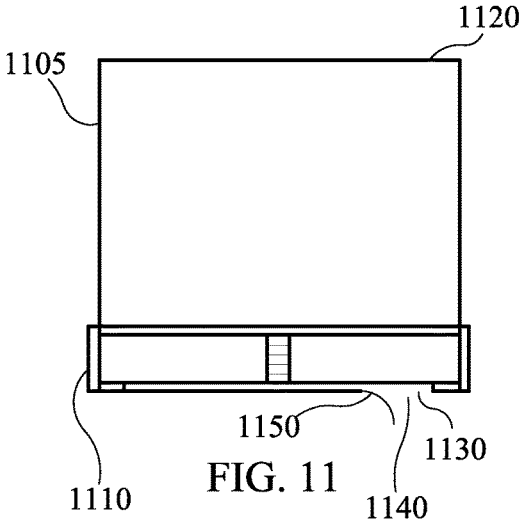
FIG. 11 is a schematic view showing an embodiment candleholder with a peelable tamper-resistant seal.

FIG. 11 demonstrates a push-up candleholder. In this embodiment, barrier 1105 fits within base 1110. Base 1110 has base opening 1130. Peelable seal 1150 is disposed across and covers base opening 1130 to prevent movement of platform and/or tampering with the candle before intended use. During use, peelable seal 1150 is removed exposing base opening 1130, and a portion of platform 1140. A user desiring to move a candle upward, makes contact with platform 1140, either by finger or other object, and applies force in the direction of candle top 1120 sufficient to drive platform 1140 upward and move candle toward candle top 1120. Barrier 1105 may be glass or metal, and may be secured to base 1110 by push fit, snap fit, or adhesively affixed. In a preferred embodiment, barrier 1105 is cylindrically shaped glass. Base 510 may be plastic, metal, wood or glass.

Figure 12:
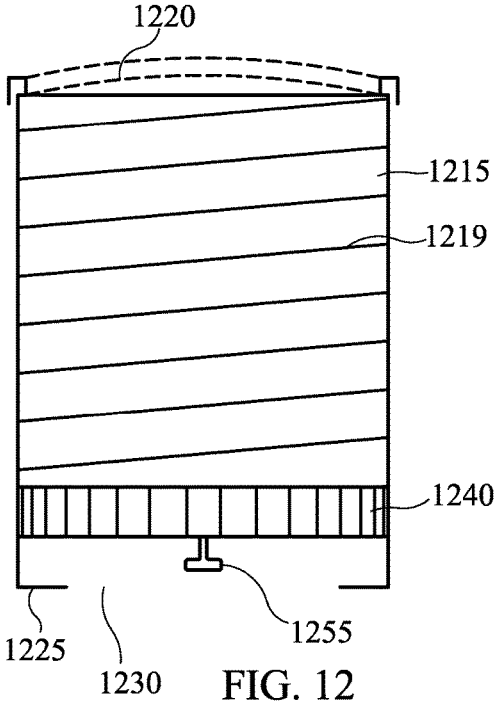
FIG. 12 is a schematic view showing an optional candleholder having a threading and rotatable platform.

FIG. 12 candleholder body 1215 is shaped to define a threading 1219 on candleholder body's 1215 inner surface. Platform 1240 has threading 1243 which mates with threading 1219 on candleholder body 1215. Platform 1240 has platform handle 1255 that may be accessed through platform access opening 1230 on bottom 1225 of candleholder body 1216 and rotated within candleholder body 1215. By virtue of threadable engagement, rotation of platform handle 1255 rotates platform 1240 and advances platform 1240 toward candle top 1220. Threading 1219 may be molded or stamped metal.

Figure 13:
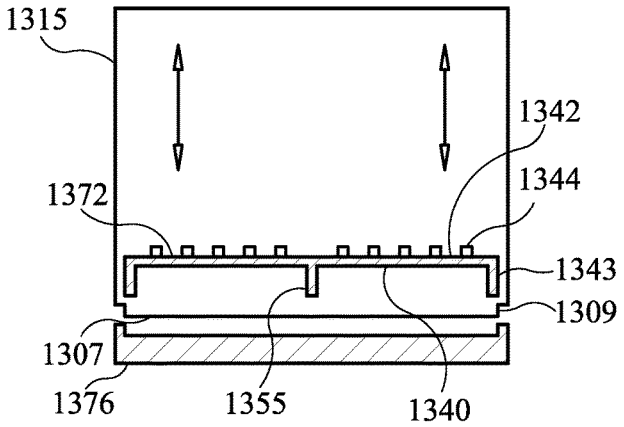
FIG. 13 is a schematic view showing an embodiment platform surface, necked-in second opening, and bottom cover.

FIG. 13. candleholder body 1315 shaped to define and open bottom 1307 and necked in bottom area 1309 which retains platform 1340 within candleholder body 1315. In an embodiment, platform 1340 is shaped to define platform sidewall 1343, which makes contact with necked in bottom area 1309 and platform handle 1355. A removable bottom cover 1376 may secure open bottom 1307 and platform 1340 until intended use, and may be used with or without a seal, such as seal 1150 (FIG. 11). Top surface 1342 of platform 1340 has a studded surface 1344 which facilitates contact with a candle. In use, a user removes bottom cover 1376 and may grip handle 1355 and move platform 1340 up or down within candleholder body 1315.

Figure 14A:
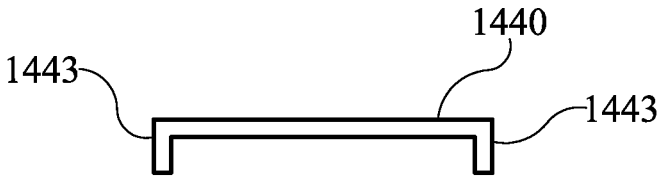
FIG. 14A is a schematic showing a handleless platform and 14B an alternative embodiment platform handle.
Figure 14B:
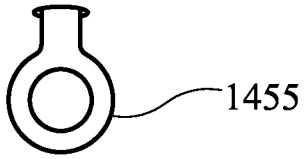

FIG. 14A demonstrates an embodiment platform 1440 omitting a handle, and featuring long sidewalls 1443. FIG. 14B shows an option where platform handle is embodied as a handle ring 1455.

Figure 15:
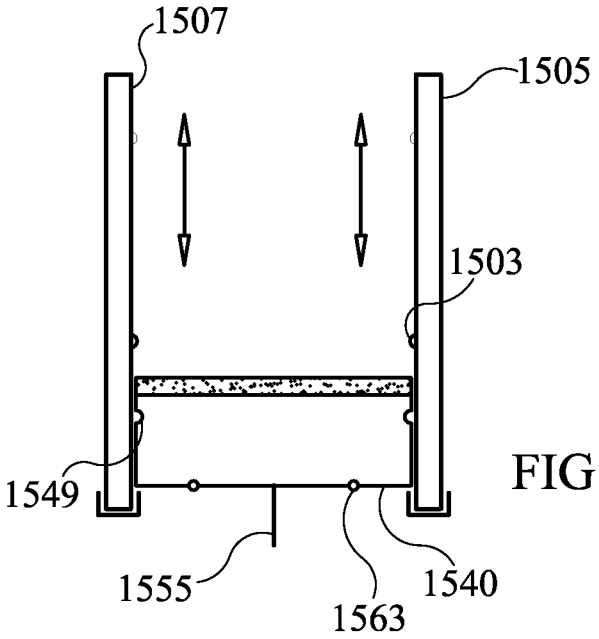
FIG. 15 is a schematic showing a flap-handle which may be extended for use and secured to platform's bottom and an embodiment platform locking means.

FIG. 15 illustrates an embodiment featuring projections 1503 on inner surface 1507 of barrier 1505. Platform 1540 is shaped to define platform recesses 1549 which are capable of engaging projections 1503 to function as a detent mechanism, maintaining platform 1540 temporarily in a fixed position relative to barrier 1505. To change positions, the user applies a force sufficient to move platform 1540 upwardly or downwardly. Projections 1503 could be on platform 1540, and recesses 1549 on inner surface 1507. Further, in one embodiment, a portion of platform 1540's bottom surface 1546 is shaped to define a foldable platform handle 1555 that may be extended perpendicular to bottom surface, and folded in either direction and secured to the bottom surface 1546 by a detent mechanism 1563. Foldable handle 1555 allows platform 1540 to be pushed or pulled along barrier 1540's long axis.

Figure 16:
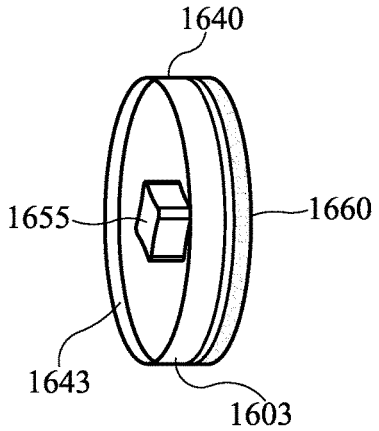
FIG. 16 is a perspective view of an embodiment platform, platform handle, and disc.

FIG. 16 shows an embodiment platform 1640 having a platform handle 1655, a disc 1660, which in one embodiment is a foam sponge rubber top, and sidewall 1643. Sidewall 1643 stabilizes the platform's 1640 position within a barrier, such as barrier 1605, or a candleholder, such as candleholder 10, preventing platform 1640 from inverting. Platform 1640 has a perimetrical surface 1603.

In all embodiments disclosed herein, the platform has a perimetrical surface—in the case of a round platform, a circumferential surface. In one preferred embodiment, a disc, such as disc 1660, is omitted, and the perimetrical surface itself is flush again the inner wall of a candleholder and the platform is self-sealing. In another embodiment, perimetrical surface has a soft seal which provides a sealing engagement with the inner wall of a candleholder.

Figure 17:
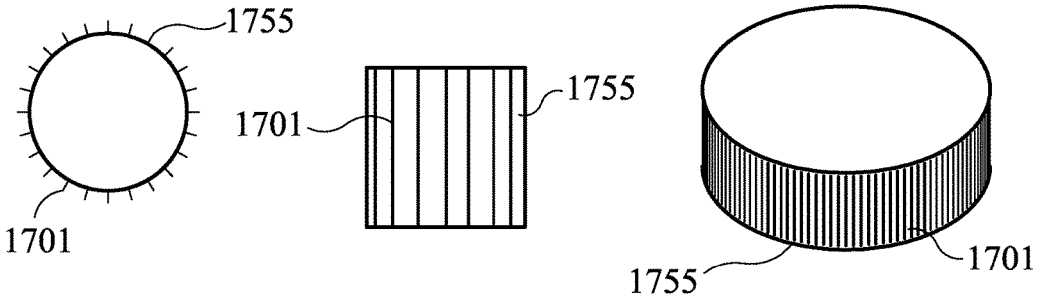
FIG. 17 is a schematic showing embodiment handle texture surfaces.

FIG. 17 demonstrates textured grip lines 1701 in handle 1755 improve a user's grip on the handle 1755 surface, improving a user's ability to push or pull handle 1755.

Figure 18:
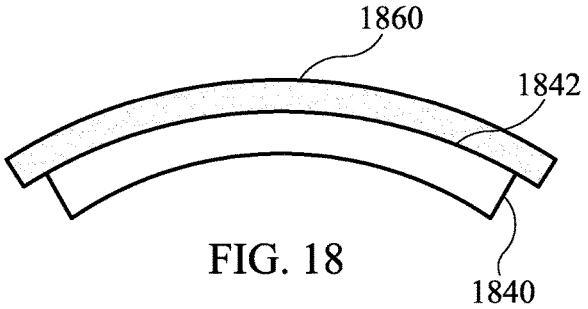
FIG. 18 is side view of an embodiment flexible platform and disc.

FIG. 18 shows a flexible platform 1840 having a platform top surface 1842, which is covered by a disc, such as foam rubber sponge 1860. Flexible platform 1842 may be deformed sufficiently to place within a barrier or candle housing in which either the top opening 20 or platform access opening 30 is a smaller diameter than platform 1840.

It should be apparent to one skilled in the art that the platform and disc share a size and shape relationship. It should be noted that a disc displaced on the top surface of a platform has been disclosed. In an alternative embodiment, a square, or other shape platform is utilized—the shape corresponding to the candleholder body's shape. According, a disc is replaced with a square candle stabilizing and sealing member, such as a square foam rubber sponge, which may be disposed on the top of a platform and used to seal the candleholder to keep wax above the level of the platform. In one embodiment, this square stabilizing and sealing member is sized slightly larger than the platform. In another embodiment, the square stabilizing member is the same size as the platform. In another embodiment, the sealing member is omitted, and a platform is sealed in the manner.

Figure 19:
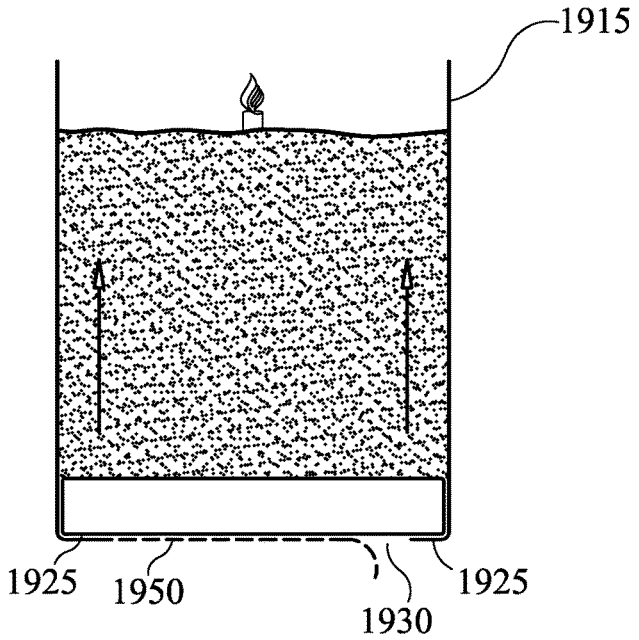
FIG. 19 is a side view of an embodiment candleholder showing a tamper-resistant seal.

FIG. 19 illustrates a molded candleholder glass container 1915 having a bottom 1925 shaped to define a platform access opening 1930. A seal 1950 covers platform access opening 1930. In one embodiment, seal 1950 is transparent. In one embodiment, seal 1950 covers platform access opening and at least a portion of the external surface of bottom 1925.

One problem frequently encountered is difficult with mobility of a candle within a candleholder. In a preferred embodiment, the candle is a soy or soy blend, palm wax, soft paraffin. These candles were unexpectedly found to provide less resistance against a candleholder's inner wall. Thus, the present invention preferentially uses semi-soft candles to facilitate the user's ability to move a candle within a candleholding vessel.

Figure 20:
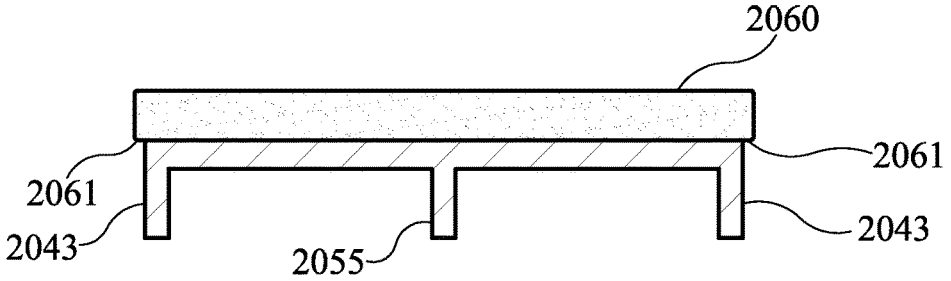
FIG. 20 is a side view of an embodiment platform showing platform, platform sidewalls, platform handle, and disc.

FIG. 20 demonstrates a platform 2040 with handle 2055 and platform sidewall 2043 and a candle stabilizing and sealing member 2060, such as a foam sponge rubber which could be in the shape of a disc. Member 2060 overhangs platform 2040 in an resulting in an overhanging portion 2061, wherein the overhanging portion makes contact with the inner wall of a candleholder such as the inner wall of candleholder body 15 (FIG. 1). When platform 2040 is advanced upwardly, the overhanging portion 2061 of member 2060 makes contact with the inner wall of a candleholder or barrier, such as the inner wall of barrier 5, or the inner wall of candleholder body, such as candleholder body 415. The ends of the overhanging portion 1461 are directed downwardly—sealing the platform within the candleholder.

Figure 21:
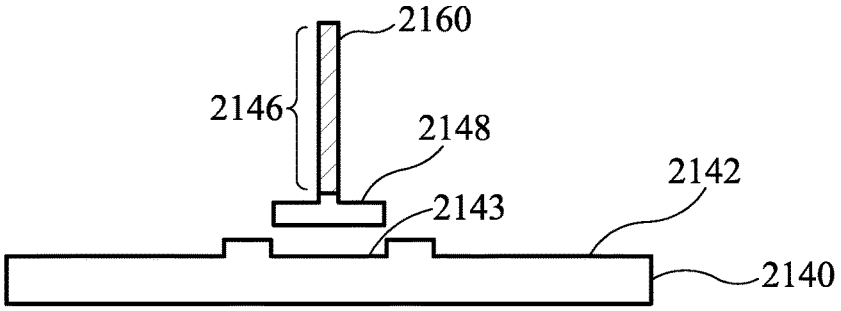
FIG. 21 is a side view of an embodiment platform showing a receptacle for a wick assembly.

FIG. 21 demonstrates an embodiment platform 2140 having a top surface 2142 bearing a wick receptacle 2143 can accommodate a push-in, or snap-in wick assembly 2146. Wick assembly 2146 is comprised of wick base 2148 attached to wick 2160. Wick base 2148 may be adhesively affixed to platform 2140—particularly where assembled in a factory setting. Alternatively, where a candleholder is sold as part of a kit, wicks may be replaceable, thus wick assembly 2146 may be reversibly affixed by push-in or snap-in attachment to wick receptacle 2143.

FIG. 22 illustrates an embodiment platform 2240 shaped to define wax gripping projections 2244. Foldable handle 2255 can be molded, glued in, or affixed adhesively.

Figure 23:
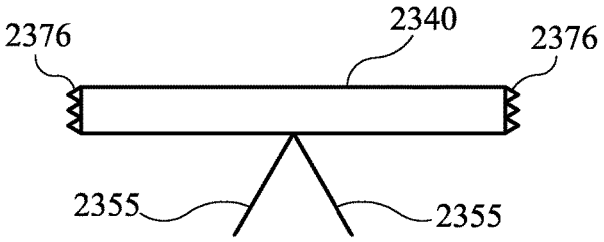
FIG. 23 is a side view of an embodiment platform showing two flap handles and a perimetrically placed seal.

FIG. 23 illustrates a platform 2340 having two foldable handles 2355. In an independent embodiment, piston 2340's is itself is molded to define flexible thin seals 2376 located on the perimeter of platform 2340 to keep wax above platform 2340. This is particularly required when filling an embodiment candleholder with hot soy, paraffin, wax, or other candle forming materials. Seals 2376 also prevent solid or semi-solid wax from moving under platform 2340 during use, when moving the candle up and down within a candleholder. Seals 2376 prevent wax from leaking when below the level of platform 2340 when flowable candle-forming material—such as hot wax—is poured into vessel.

Figure 24:
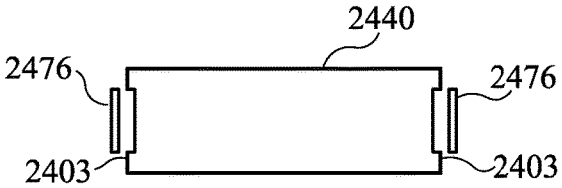
FIG. 24 is a side view of a platform having a perimeter seal.

FIG. 24 illustrates an embodiment wing seal 2476 on platform 2440. Wing seals 2476 are formed by affixing rubber, silicone, plastic, or urethane to the perimeter border 2403 of platform 2440. Wing seals 2476 keep wax above platform 2440, particularly when filling a candleholder with hot soy, paraffin, wax, or other candle forming materials. Wing seals 2476 also prevent wax from moving under platform 2440 during use, when moving the candle up and down within a candleholder. Seals 2476 permit a sealed sliding engagement between platform 2440 and inner surface of a barrier or candleholder body.

Figure 25:
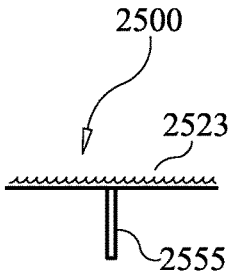
FIG. 25 is a side view of an adhesively attachable handle.

FIG. 25 describes an embodiment stick-on handle assembly 2500 which has an adhesive surface 2523 and a peel-out handle tab 2555. Handle tab 2555 may be peeled back, and used to push or pull a platform. A peelable handle 2555 can be affixed to the bottom surface or a platform, such as bottom surface of platform 2040 or platform 2440 allowing a platform to be manipulated—specifically allowing platform to be pulled back. In one embodiment a prepackaged LIFT 'N' PEEL® brand peelable handle could be utilized.

Figure 26:
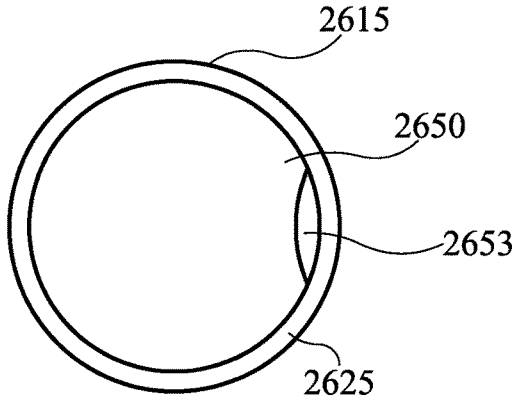
FIG. 26 is a bottom view of an embodiment candleholder showing an embodiment tamper-resistant seal and pull tab.

FIG. 26 illustrates a bottom view of the bottom 2625 of candleholder body 2015 having seal 2650, which could be clear or opaque, having a pull tab 2653. Seal 2650 prevents tampering. In another embodiment, a removable cover, such as removable bottom cover 1376 is fittable over bottom 2625 to seal a candleholder body opening such as base bottom surface opening 30.

Figure 27:
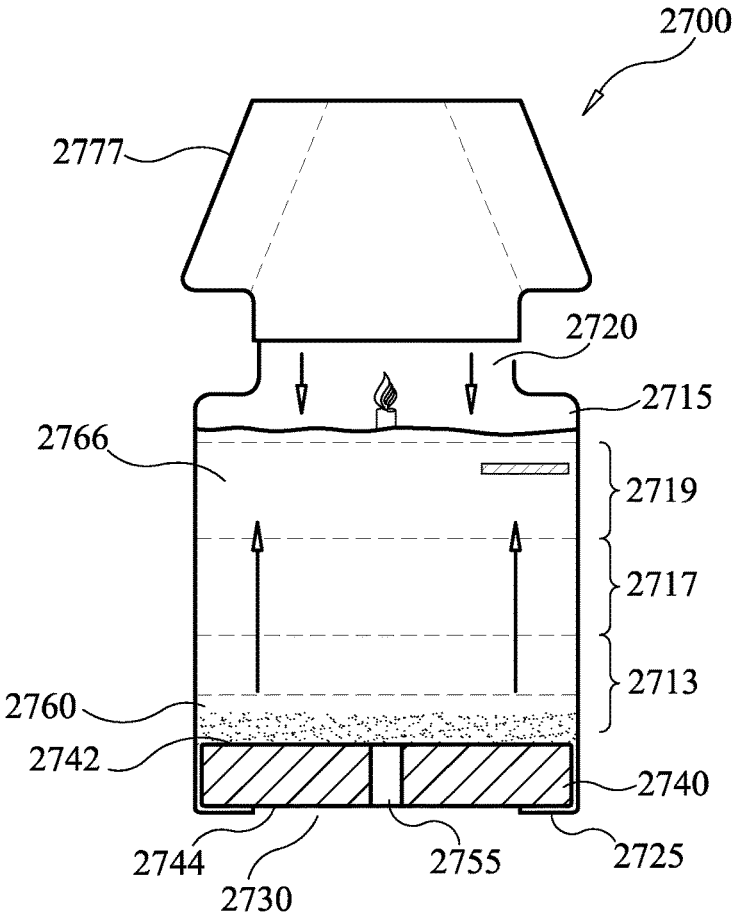
FIG. 27 is a schematic showing an embodiment candleholder with necked-in shape, a shade, and opaque, semi-opaque, and clear label zones.

FIG. 27 illustrates an embodiment candle product 2700 with candleholder body 2715 and candle 2766 set within. Candle 2766 is formed of soft wax materials, such as soy wax, and disposed on a disc which is in one embodiment, foam sponge rubber top 2760. The foam sponge rubber top 2760 is disposed on the top surface 2742 of platform 2740. Platform 2740 is within candleholder body 2715. Bottom surface 2744 of platform 2740 is shaped to define a handle 2755. Candleholder body 2715 has a bottom 2725 with candleholder bottom opening 2730. A tamper evident seal (such as shown by 1950 in FIG. 19) may cover bottom opening 2730. In one embodiment, at least one label is located on the outer aspect of candleholder body 2715. The first label is located in the bottom zone 2713 of the outside of candleholder body 2715 and is opaque and designed to hide platform 2740. A semi-clear label is located on the middle zone 2717 of candleholder 2715. A clear label is in the top zone 2719 of candleholder. A lamp shade 2777 fits into top opening 2720 of candleholder body 2715.

Figure 28:
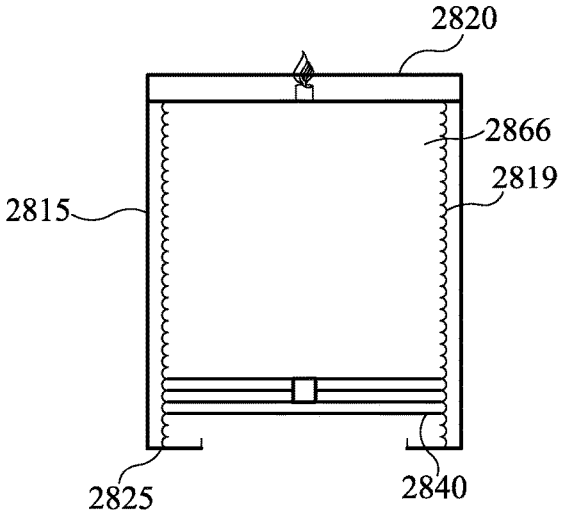
FIG. 28 is a schematic showing an embodiment internal threading and rotatable platform.

FIG. 28 illustrates a method of lifting candle 2866 within candleholder through use of heat resistant internal threading 2819 along the circumferential inner wall of candle housing 2815. Threading 2819 can be integrally formed, or can be a freestanding insert inserted into candleholder body 2815. Platform 2840 has handle 2855, which may be twisted to elevate platform 2840 and candle 2866 upwardly toward open top 2820, or rotated in the opposite direction to move candle 2866 downwardly toward candle bottom 2825.

Figure 29:
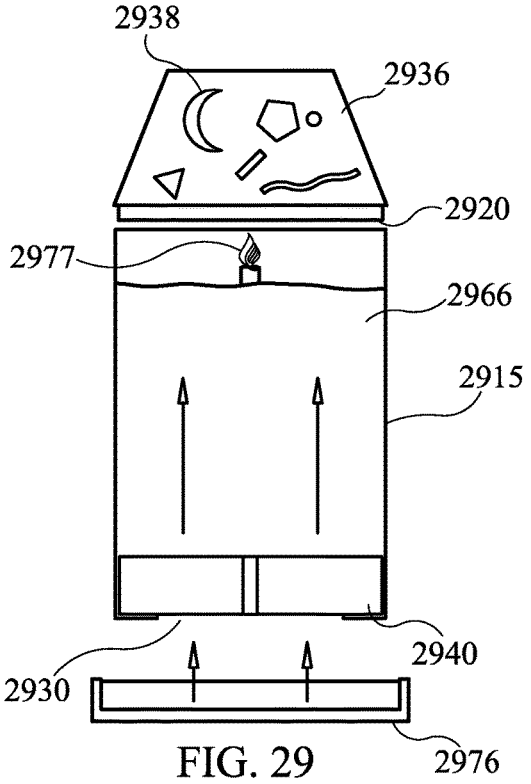
FIG. 29 is a schematic view showing an embodiment cover with vents and base.

FIG. 29 illustrates a candle 2966 within a candleholder body 2915. Platform 2940 is disposed within candleholder body 2915. Base bottom opening 2930 is covered by a seal which may be seal 1950 (FIG. 19); the seal may be clear, foil, or a pop metal seal. A shade 2936 is fitted to candleholder top 2920, with at least one vent hole 2938 in the candleholder shade 2936. Shade 2936 may be formed of glass, tin, or other metal and used when the candle is burning. Shade 2936 provides light inside the shade. A candle flame 2977 burning at the relative top of a candleholder body 2915, an optimal burning zone, and provides more light, more scent, and burns better and brighter.

Figure 30:
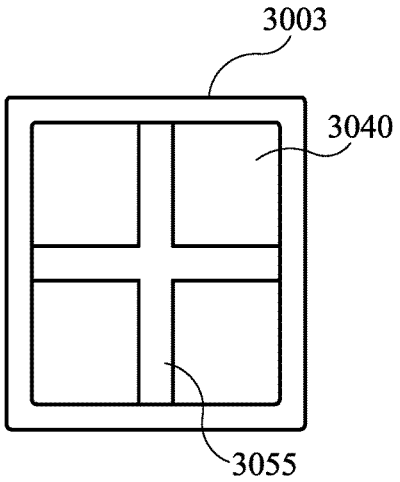
FIG. 30 is a bottom view of an embodiment square platform.

FIG. 30 shows a bottom view of a square embodiment platform 3040 demonstrating platform handle 3055. Square embodiment platform may be used in a cuboidally shaped candleholder body.

Figure 31:
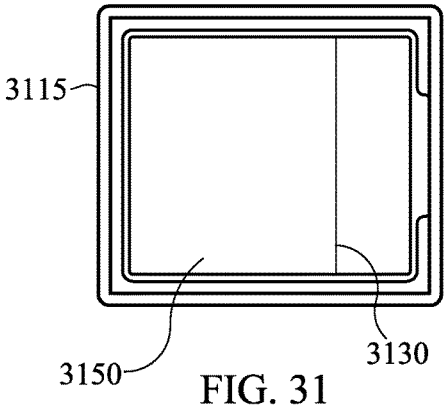
FIG. 31 is a bottom view of an embodiment cuboidally shaped candleholder having a tamper-resistant seal.

FIG. 31 is a bottom view of an embodiment cuboidally shaped candleholder barrier 3115 showing a cuboidally shaped glass, tin, or other metal candleholder body 3115 shaped to define platform access opening 3130 covered with seal 3150. It should be noted that platform access opening 3130 is smaller than platform 3040 to be sure platform 3040 is retained within candleholder body 3115. As with the circumferential embodiments, a cuboidally shaped embodiment may be integrally formed.

Figure 32:
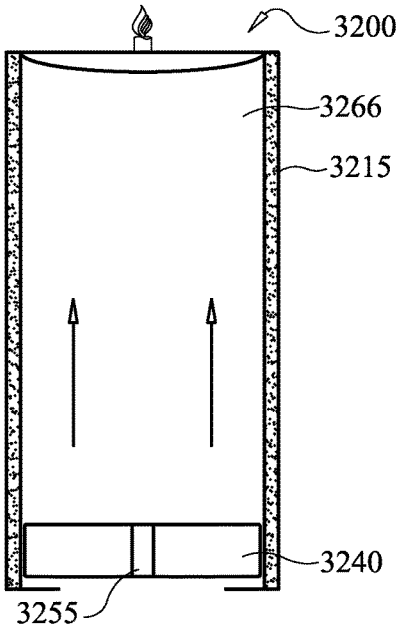
FIG. 32 is a schematic view of an embodiment simulated wax pillar candleholder.

FIG. 32 demonstrates a simulated pillar candle 3200 having a push or twist platform 3240 to drive candle 3266 upwardly. The exterior of candleholder body 3215 features simulated wax—emulating the look of an authentic pillar candle.

Figure 33:
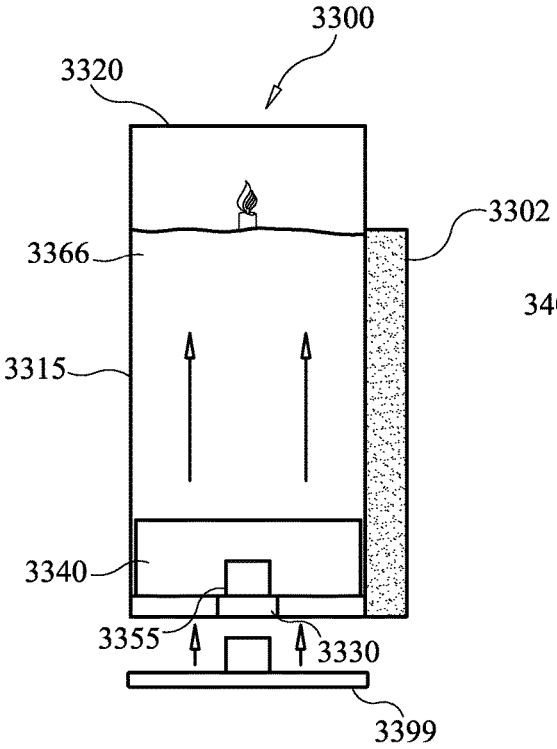
FIG. 33 is an embodiment of a novena-style candleholder.

FIG. 33 illustrates a novena-style candle 3300, which is relatively tall and thin. Candle 3366 is within candleholder body 3315 and atop platform 3340 within. Candle 3300 is packaged with push-up rod 3302. Candleholder body 3315 is shaped to define platform access opening 3330. When the user desires to advance platform 3340, the user inserts rod 3302 through access opening 3330 and applies sufficient force to raise platform 3340 and candle 3366 upwardly toward candle top 3320. In one embodiment, instead of a handle, platform 3340 is shaped to define a void 3355, and rod 3302 may be inserted into that void to more effectively move platform 3340 upwardly. In one embodiment void 3355, and one end of rod 3302, have mateable threading, such that one end of rod 3302 may be screwed into void 3355, allowing platform 3340 to be pushed or pulled. When a user is finished adjusting candle height, the user unscrews rod 3302 from void 3355, and platform 3340 with candle 3366 atop, maintains its position. Base cover 3399 may fit within platform access opening 3330 and may also serve, in one embodiment, as a push base to provide support one end of rod 3302 during the application of force to raise platform 3340.

Figure 34:
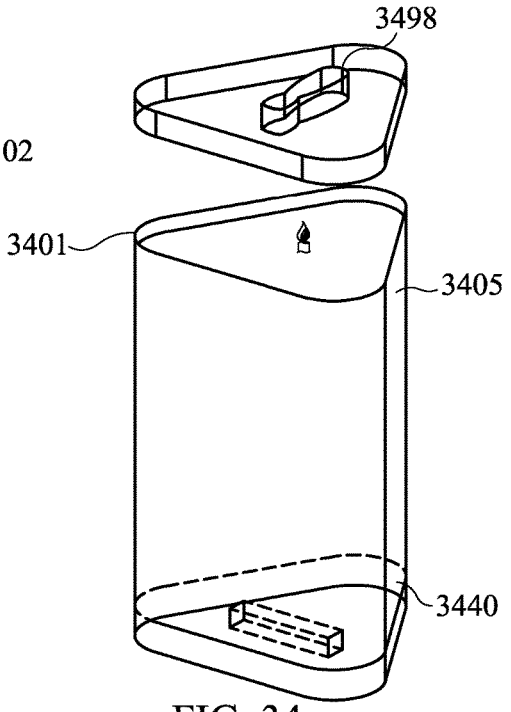
FIG. 34 is an embodiment disclosing an alternatively shaped candleholder body.

FIG. 34 shows a triangularly-shaped candleholder 3400, wherein the candleholder body 3405 has rounded corners 3401, featuring a cover 3496 shaped to define a brush holder 3498 to hold a brush. Platform 3440 is similarly shaped to substantially occupy the void across the short axis of body 3405.

Figure 35:
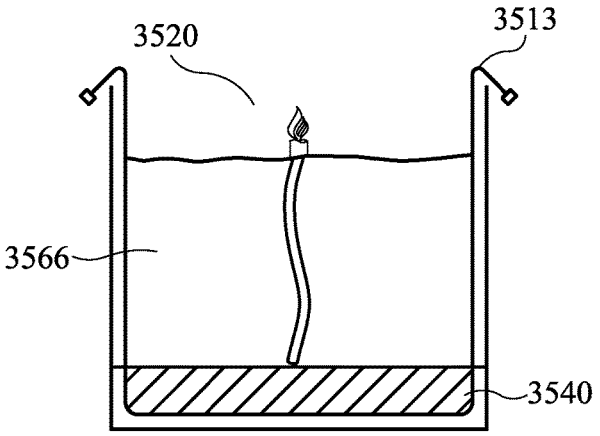
FIG. 35 is side view an embodiment candleholder showing a wire for elevating platform.

FIG. 35 illustrates a pull-up wire 3513 where wire 3513 is located under platform 3540. In use, a user pulls wire 3513 causing tension in wire 3513 and elevation of platform 3540 toward candle opening top 3520.

Figure 36:
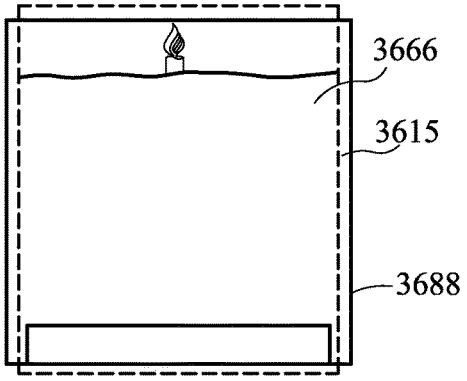
FIG. 36 is a side view of an embodiment candleholder showing an embodiment overlay.

FIG. 36 demonstrates a tin container candleholder body 3605 with an overlay 3688 which may be clear or printed, located on the outside of candleholder body 3605. In an alternative, clear glass or plastic container body 3605, overlay is located on the outside of candleholder body 3605, but could be inside as well, as it will be visible through the clear glass or plastic.

Figure 37:
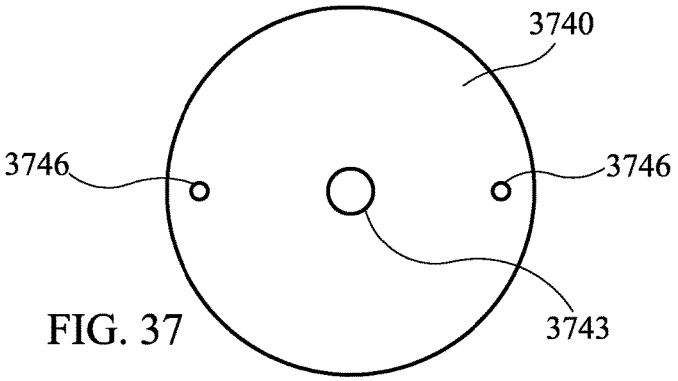
FIG. 37 is an embodiment wire actuated platform.

FIG. 37 demonstrates an embodiment platform 3740 having a central wick hole 3743 and at least one wire hole 3746, in a preferred embodiment there being a plurality of wire holes 3746. Wire holes permit wire 3513 (FIG. 35) to be passed through platform 3740 and secured along the bottom surface of platform 3740. In use, a user can pull wire 3513 that is secured under platform 3740, which draws platform 3740 upwardly.

Figure 38:
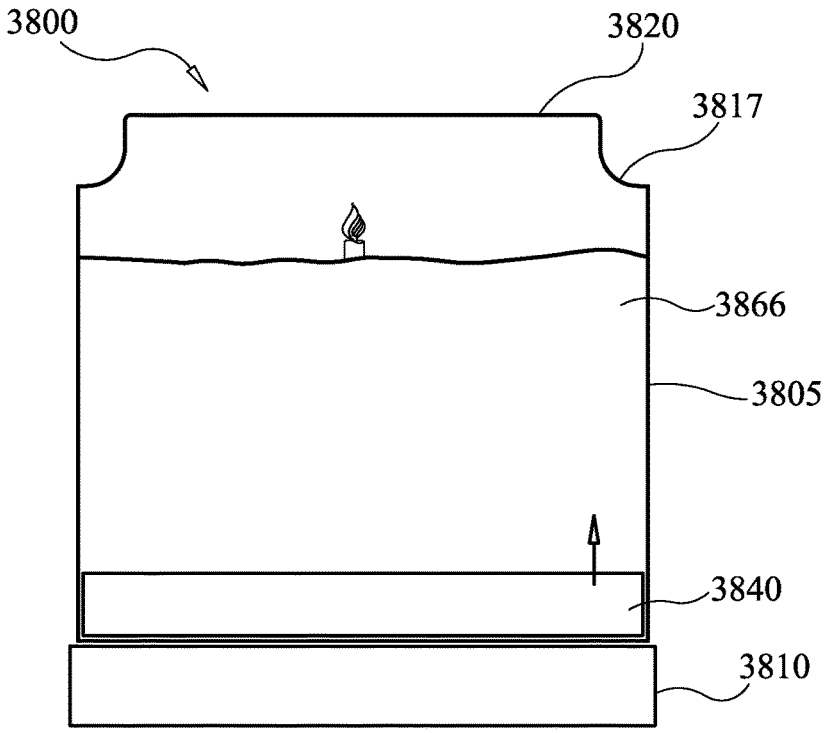
FIG. 38 is a side view of an embodiment candleholder showing a necked-in shape.

FIG. 38 illustrates a candleholder 3800 shaped to define a tapered top opening 3820. A sufficient force applied to platform 3840 will move platform 3840 and candle 3866 upwardly, toward top opening 3820. Candle 3866 is prevented from moving past necked-in tapered point 3817. Barrier 3805 sits within base 3810.

Figure 39:
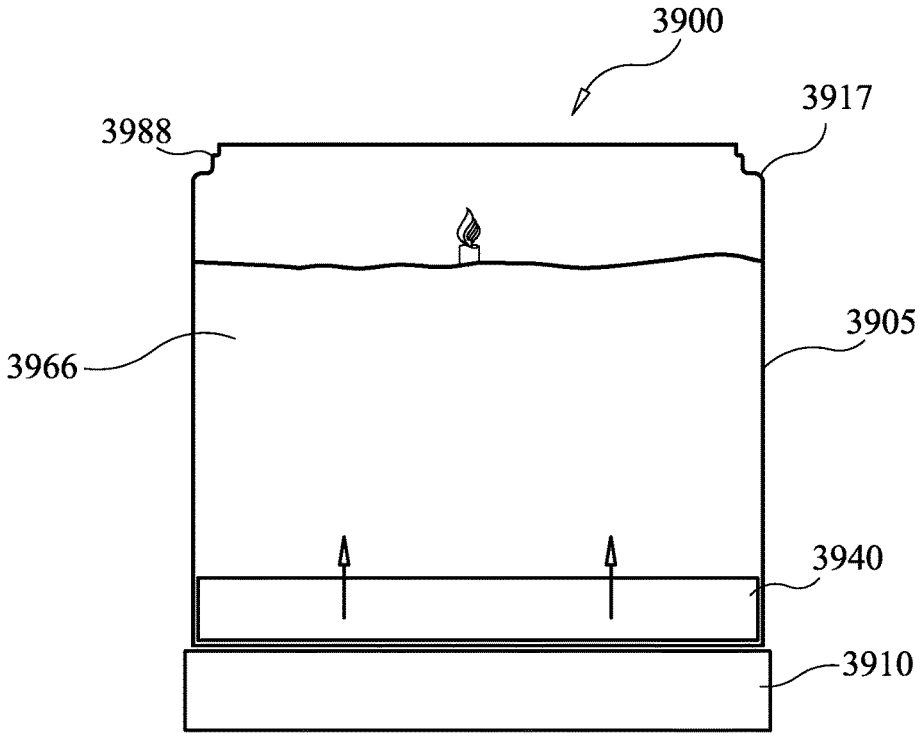
FIG. 39 is a side view of an embodiment glass candleholder showing a tapered shape.

FIG. 39 illustrates an embodiment candleholder 3900 where barrier 3905 is glass and within base 3910. Ridges 3988 and tapered point 3917 prevent candle 3966 from moving past opening 3920 as platform 3940 moves candle 3966 against the inner wall of barrier 3905.

Figure 40:
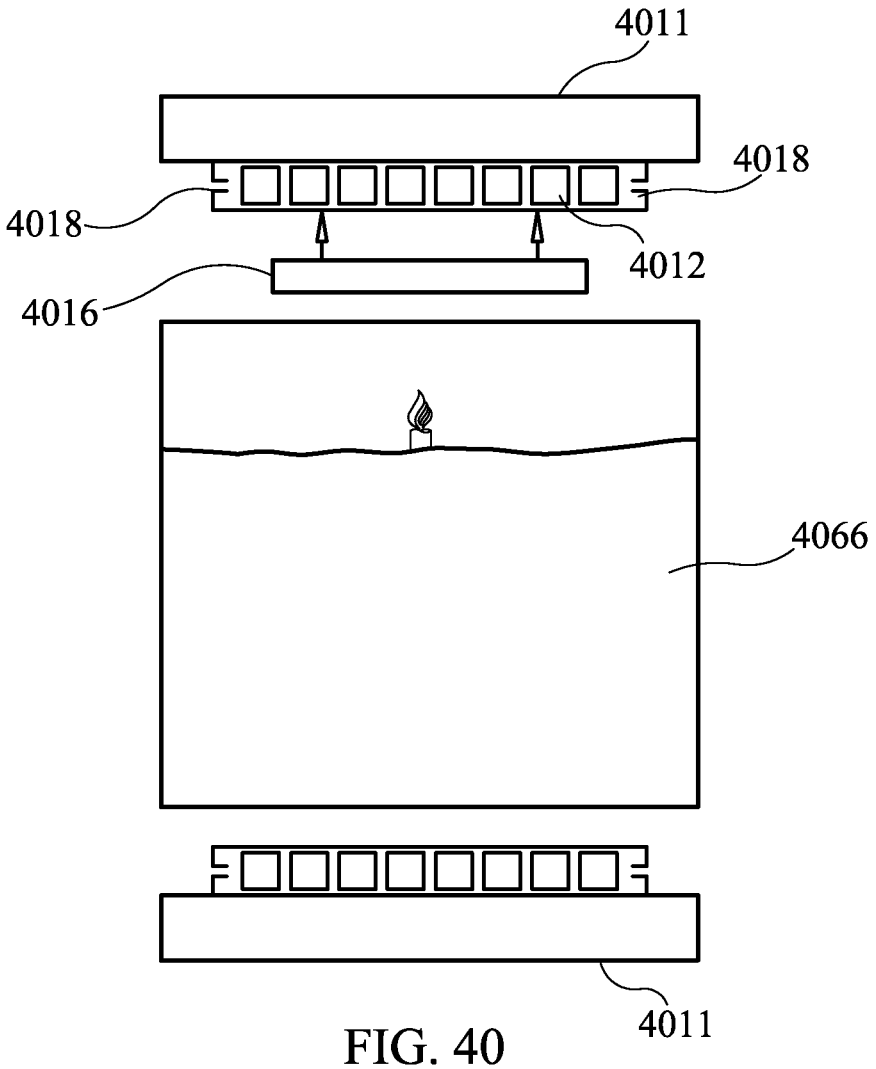
FIG. 40 is a schematic view of an embodiment candleholder having a vented top, scent holes, and scent chip.

FIG. 40 illustrates an embodiment candleholder 4000 having a cover 4011 with scent holes 4012 with a scent chip 4016 which may be reversibly affixed to cover 4011. In one embodiment, chip 4016 is snappably affixed to cover 4011. Vents 4018 may be opened or closed to facilitate candle flame burning and the dissipation of scent. When not in use, cover 4011 may be removed from candleholder and inverted to provide scent.

A preferred embodiment of the present invention discloses an integrally molded candleholder body having an inner surface, a first end, and second end, wherein the second end is shaped to define a molded bottom and a bottom surface opening; a platform sized to fit within a candleholder body, such that the platform is perpendicularly disposed relative to the inner surface, wherein said platform is sized to substantially fill the void of the candleholder body, wherein said platform shaped to define a top platform surface, wherein the platform is sized greater the base bottom surface opening, wherein said platform has a perimeter; a seal affixed to at least a portion of platform's perimeter; wherein a user may move a candle disposed on said platform, within said candleholder body in the direction of the first end, wherein a candle, as it is consumed, may be advanced such that a candle surface may be maintained near the first end.

Embodiments of this invention have disclosed a platform that substantially fills the void across barrier or candleholder body. An optimal embodiment has found to be a platform length of at least 70% of the void in the diameter. Further, embodiments of this invention have disclosed an optimal burning zone for a candle flame. An optimal embodiment has found an optimal burning zone to be within 15 centimeters from a candleholder top.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, which are not specified within the detailed written description or illustrations contained herein yet, are considered apparent or obvious to one skilled in the art are within the scope of the present invention. Further, it should be noted that several inventive embodiments are disclosed together for convenience; unless specified otherwise, all embodiment inventive options disclosed herein may be used independently or together with any other embodiment.

I claim:

1. A candleholder allowing a candle to be raised or lowered within the candleholder comprising:

a cylindrically shaped candle barrier having a first end and second end, wherein said cylindrical candle barrier has a diameter and diametrical void, wherein said cylindrical candle barrier has a short axis and long axis;

a base affixed to the second end of cylindrical candle barrier, the base having a bottom surface, wherein said base is shaped to define a base bottom opening having a diameter; a platform having a diameter, wherein said platform's diameter is less than the diameter of said cylindrical candle barrier, wherein the platform is sized to substantially fill the diametrical void of the barrier across the short axis of said cylindrical candle barrier, wherein said platform is shaped to define a handle, wherein said platform shaped to define a top surface and a sidewall, wherein the diameter of the platform is greater than the diameter of the base bottom surface opening;

a disc disposed on the top surface of platform, wherein said disc has a diameter, wherein the diameter of the disc is larger than the diameter of the platform, wherein said disc is formed of a soft rubber sponge, whereby the soft rubber sponge stabilizes a candle and prevents candle wax from moving below the platform's surface;

wherein a user may move a candle disposed on said platform in the direction of the long axis of said cylindrical candle barrier, in the direction of the first end, wherein a candle, as it is consumed, may be advanced such that a candle surface may be maintained near the relative first end; wherein said candle is a soft candle selected from the group consisting of: soy, soy blend, palm wax, soft paraffin;

a peelable tamper-resistant seal disposed across and covering base opening, wherein said seal prevents platform movement and/or tampering before intended use.

2. The candleholder of claim 1, further comprising a candle disposed on said disc within the candleholder.

3. A candleholder allowing a candle to be raised or lowered within the candleholder comprising:

a cylindrically shaped candleholder body having a first end and second end, and inner surface, wherein said cylindrical candle body has a diameter and diametrical void, wherein said cylindrical candle body has a short axis and long axis, wherein the second end is shaped to define a molded bottom defining a molded bottom opening having a diameter;

a platform having a diameter, wherein said platform's diameter is less than the diameter of said cylindrically shaped candleholder body, wherein said platform is sized to substantially fill the diametrical void of the barrier across the short axis of said cylindrical candle barrier, wherein said platform is shaped to define a handle, wherein said platform shaped to define a top surface and a sidewall, wherein the diameter of the platform is greater than the diameter of the base bottom surface opening;

a soft seal disposed on the perimetrical surface, wherein said seal provides a sealing engagement with the inner wall of the candleholder;

wherein a user may move a candle disposed on said platform in the direction of the long axis of said cylindrical candle barrier, in the direction of the first end, wherein a candle, as it is consumed, may be advanced such that a candle surface may be maintained near the relative first end;

wherein said candle is a soft candle selected from the group consisting of: soy, soy blend, palm wax, soft paraffin;

a peelable tamper-resistant seal disposed across and covering base opening, wherein said seal prevents platform movement and/or tampering before intended use.

4. The candleholder of claim 3, further comprising a candle disposed on said disc within the candleholder.

* * * * *